US008246393B2

(12) United States Patent
Geibel et al.

(10) Patent No.: US 8,246,393 B2
(45) Date of Patent: Aug. 21, 2012

(54) IMPLOSION CONNECTOR AND METHOD FOR USE WITH TRANSMISSION LINE CONDUCTORS COMPRISING COMPOSITE CORES

(75) Inventors: Dean E. Geibel, New Cumberland, PA (US); Bernard C. Crutcher, Londonderry, NH (US)

(73) Assignee: Hubbell Incorporated, Shelton, CT (US)

( * ) Notice: Subject to any disclaimer, the term of this patent is extended or adjusted under 35 U.S.C. 154(b) by 965 days.

(21) Appl. No.: 12/046,122

(22) Filed: Mar. 11, 2008

(65) Prior Publication Data

US 2008/0233787 A1 Sep. 25, 2008

Related U.S. Application Data

(60) Provisional application No. 60/906,354, filed on Mar. 12, 2007.

(51) Int. Cl.
*H01R 4/10* (2006.01)

(52) U.S. Cl. ..... 439/877

(58) Field of Classification Search ..... 174/91, 174/92, 84 C, 71 R, 94 R; 439/877–882
See application file for complete search history.

(56) References Cited

U.S. PATENT DOCUMENTS

| | | | | |
|---|---|---|---|---|
| 2,761,892 | A * | 9/1956 | Newell | 174/92 |
| 2,959,436 | A | 11/1960 | Duda | 287/75 |
| 3,134,844 | A * | 5/1964 | Myers | 174/94 R |
| 3,670,090 | A | 6/1972 | Osteng | 174/90 |
| 3,875,326 | A * | 4/1975 | Hofer | 174/94 R |
| 4,508,409 | A * | 4/1985 | Cherry et al. | 439/391 |
| 2004/0026112 | A1 | 2/2004 | Goldsworthy et al. | 174/106 |
| 2004/0131851 | A1 | 7/2004 | Hiel et al. | 428/375 |
| 2004/0182597 | A1 | 9/2004 | Smith et al. | 174/126.1 |
| 2005/0006129 | A1 | 1/2005 | Bryant | 174/88 |
| 2005/0227067 | A1 | 10/2005 | Hiel et al. | 428/364 |
| 2006/0016616 | A1 | 1/2006 | Goldsworthy et al. | 174/128.1 |
| 2006/0051580 | A1 | 3/2006 | Bryant et al. | 428/375 |
| 2006/0084327 | A1 | 4/2006 | Chadbourne | 439/784 |

FOREIGN PATENT DOCUMENTS

| | | |
|---|---|---|
| CA | 2054115 A1 | 4/1993 |
| JP | 05347163 | 12/1993 |
| JP | 09266017 | 10/1997 |
| JP | 09306556 | 11/1997 |
| JP | 2002 218621 | 8/2002 |
| JP | 2007 059204 | 3/2007 |

OTHER PUBLICATIONS

"New Implosive Connector Technology for Hight Voltage Conductors" by C. Pasini 8th IEE International Conference on AC and DC Power Transmission, Mar. 2006, 5 pages.

Clarke N. A., "Explosive overhead connection technique overcomes the 'creep' problem", May 19, 1978, pp. 39-41, Electrical Review, vol. 202, No. 19.

Jintang Lu et al., "A Study on the Physical Effects in Explosive Compression Jointing Process of ACSR", Oct. 17-22, 1987, pp. 363-367, Beijing, China, IEEE/CSEE Joint Conference on High-Voltage Transmission Systems in China.

Contestabile E. et al., "Suppression of Blast Pressure and Noise From Implosive-Type Connectors", pp. 157-174.

* cited by examiner

*Primary Examiner* — Ross Gushi
(74) *Attorney, Agent, or Firm* — Harrington & Smith

(57) ABSTRACT

An electrical connector that can be compressed onto a composite transmission line without causing catastrophic damage to the non-metal/steel core. The electrical connector comprises a sleeve and a compression regulator that limits compression of the sleeve.

19 Claims, 8 Drawing Sheets

IMPLOSION CONNECTOR AND METHOD FOR USE WITH TRANSMISSION LINE CONDUCTORS COMPRISING COMPOSITE CORES

CROSS REFERENCE TO RELATED APPLICATION

This application claims the benefit under 35 U.S.C. §119 (e) of U.S. Provisional Patent Application No. 60/906,354 filed Mar. 12, 2007 which is hereby incorporated by reference in its entirety.

BACKGROUND OF THE INVENTION

1. Field of the Invention

The present invention generally relates to an electrical connector and a method of applying an electrical connector to a transmission line. More particularly, the present invention includes imploding an electrical connector onto a transmission line that comprises a non-steel core.

2. Brief Description of Prior Developments

A method of imploding electrical connectors onto a steel core is described in "New Implosive Connector Technology for High Voltage Conductors", Pasini, The 8th IEEE International Conference on AC and DC Power Transmission, Savoy Place, London, UK, March 2006.

Non-metal cores, composite cores, and linearly driven wedge connectors for composite cores are described in US Patent Publication Nos. 2004/0182597; 2004/0026112; 2004/0131851; 2005/0006129; 2005/0227067; 2006/0016616; 2006/0051580; and 2006/0084327. Each of these documents are incorporated by reference in their entirety.

U.S. Pat. No. 4,511,280 describes an anti-bird caging connector. This document is incorporated by reference in its entirety.

SUMMARY OF THE INVENTION

One aspect of the present invention is to attach an electrical connector to an object, such as a composite core transmission line. Non-metal/steel cores typically have a high tensile strength but also have a compression failure or crush point that is less than steel or stranded steel cable. For example, carbon composite core materials may have a compression failure or crush point of about 4000 pounds per square inch.

A strong frictional force is needed between the non-steel core and/or a conductor carried by the non-steel core and the electrical connector to keep the transmission line suspended above the ground. Therefore, the non-steel core has to withstand enough compressive force to frictionally secure the electrical connector to the transmission line, yet be controlled so that the non-steel core is not catastrophically damaged during the axial or radially inward compression of the non-steel core and/or the conductor.

The present invention is therefore directed to an electrical connector that is radially inwardly compressed onto a non-metallic or non-steel core, such as a carbon-based core. In one embodiment, the electrical connector comprises a sleeve may be radially imploded onto the non-steel core directly or onto the conductor positioned adjacent to the non-steel core. Other radial compression mechanisms, such as hydraulic or manual compression, are also contemplated.

In accordance with one aspect of the invention, an electrical connector is provided comprising a sleeve and a compression regulator. The sleeve comprises an electrically conductive metal material and a channel adapted to receive an end of a non-steel core. The compression regulator is configured to prevent the non-steel core from being crushed when the sleeve is radially inwardly compressed around the non-metal core.

An implosion section can be provide comprised of explosive material, wherein the implosion section surrounds a portion of the sleeve. The compression regulator can be comprised of a compressible material positioned adjacent to the non-metal core. The compression regulator can be comprised of a plurality of spaced apart sections that each extend from an interior surface of the sleeve. The compression regulator can comprise walls of the sleeve that are interlaced together. The sleeve can comprise two pieces or more. The compression regulator can comprise tapered slots and tapered wedges that fit into the tapered slots with an increased interference fit. The compression regulator can comprise a slot, a tab that fits into the slot, and wherein the tab is shorter in length than the slot. The compression regulator can comprise a gap in the sleeve. A compressible material can be located in the gap. The compression regulator can comprise is brakes or lands and grooves in an interior wall of the sleeve section at the channel. An interior wall of the sleeve at the channel can comprise a plurality of recesses extending into the interior wall from the channel. The compression regulator can comprise a plurality of tapered members that are separated from each other prior to compression and each extend into a respective one of the plurality of recesses. A channel can be formed by a wall of the sleeve which at least partially overlaps itself between the channel and an outer slide of the sleeve.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

The present invention generally relates to attaching an electrical connector onto an electrical a transmission line comprising a non-steel core and/or a conductor wrapped around the non-steel core.

Figure 1:
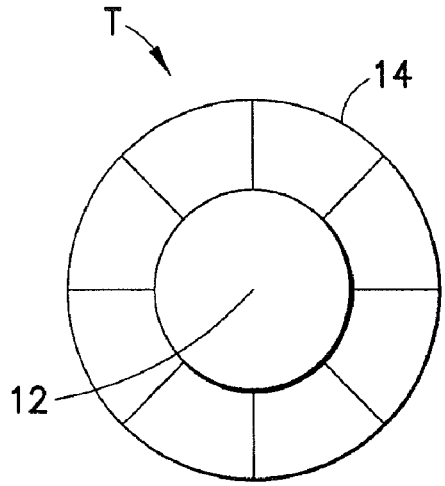
FIG. 1 is an end view of a transmission line with a non-metal core and a conductor wrapped around the non-metal core.
Figure 2:
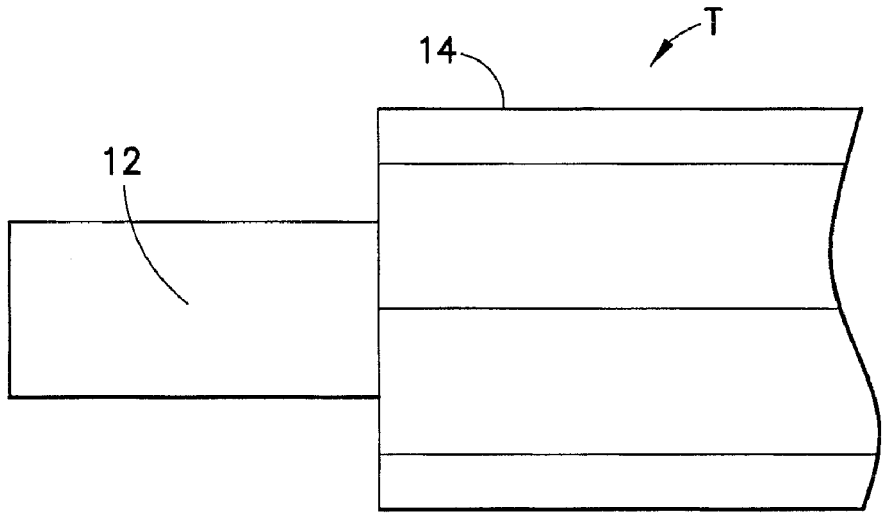
FIG. 2 is a side view of the transmission line shown in FIG. 1.

As shown generally in FIGS. 1-2, the present invention generally relates to an electrical connector 10 (FIG. 3) that is adapted to connect to a non-steel core 12 and/or a conductor 14 of a transmission line T. The conductor 14 may be aluminum or some other suitable material, and in one embodiment comprises strands wrapped around the non-steel core 12.

As shown generally in FIGS. 3-19, each electrical connector 10 (FIG. 3) generally comprises a sleeve 16-16P and a compression regulator. The sleeves 16-16P are preferably made from steel, aluminum, plastic, conductive plastic, or other suitable material and are preferably hollow and compressible. The sleeves 16-16P shown in FIGS. 3-19 are adapted to be positioned over the non-steel core 12 or the conductor 14 shown in FIGS. 1 and 2. The sleeves 16-16P may define an exterior surface 18-18P that may be cylindrical or some other suitable shape.

An explosive material 20, 20A (FIGS. 3 and 8) may be positioned on the exterior surfaces 18-18P of the sleeves 16-16P. The explosive material 20, 20A may be symmetrically or asymmetrically arranged along a length of the sleeves 16-16P or on an exterior surface of a second sleeve that fits over the exterior surfaces 18-18P of the one or more of the sleeves 16-16P. A resilient spacer (FIG. 14) may be positioned between the exterior surfaces 18-18P of the sleeves 16-16P and the explosive comprise additional interior or exterior sleeves, wedges, or wraps.

Interior surfaces 22-22P of the sleeves 16-16P may have continuous, unbroken surfaces. Alternatively, as shown in FIGS. 4-8, 11, 12, and 15-19, the interior surfaces 22A-22E, 22H, 22I, 22L-22P of sleeves 16A-16E, 16H, 16I, 16L-16P of may also define breaks 24, gaps 26, or lands 40 and grooves 42.

Figure 3:
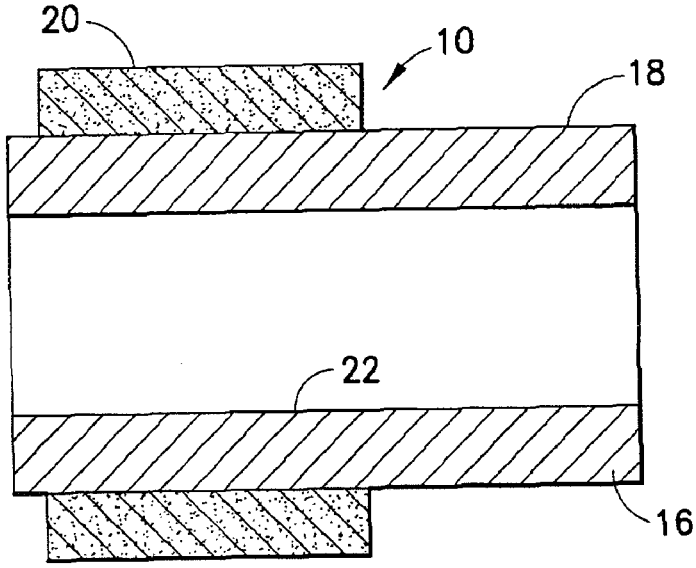
FIG. 3 is a cross-sectional side view of an electrical connector and explosive material according to one embodiment of the present invention.

For example, FIG. 3 shows an electrical connector 10 comprising a sleeve 16 with an interior surface 22, and exterior surface 18. Explosive material is positioned adjacent to the exterior surface 18 of the sleeve 16.

Figure 4:
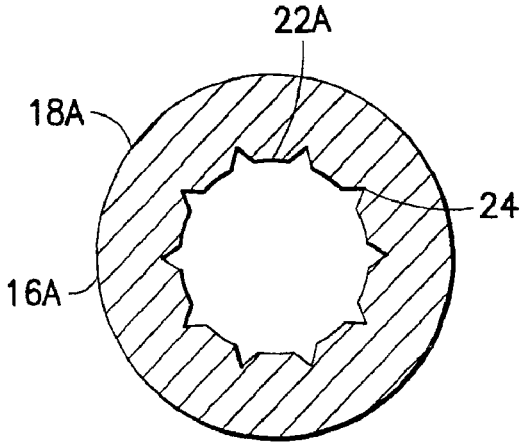
FIG. 4 is a cross-sectional end view of an electrical connector according to a second embodiment of the present invention.

FIG. 4 shows a sleeve 16A with an interior surface 22A and an exterior surface 18A. Breaks 24 are added to help absorb energy during radial compression of the sleeve onto a non-steel core or conductor, such as the core 12 and conductor 14 shown in FIGS. 1 and 2.

Figure 5:
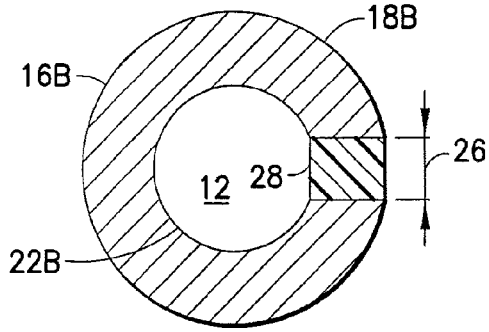
FIG. 5 is a cross-sectional end view of an electrical connector according to a third embodiment of the present invention.

As shown in FIG. 5, sleeve 16B can define an interior surface 22B, an exterior surface 18B, and a cross-sectional C-shape with a gap 26 defined between two opposing edges of the sleeve 16B. The opposing edges can be angled with respect to each other so that a compressible material 28 is squeezed outwardly away from the non-steel core 12 during compression. The compressive material 28 may be positioned in the gap 26 to help absorb implosive force. The gap 26 may also be sized so that only a predetermined amount of force will be exerted on the core 12 by the sleeve 16B during according to its particular compression properties.

Figure 6:
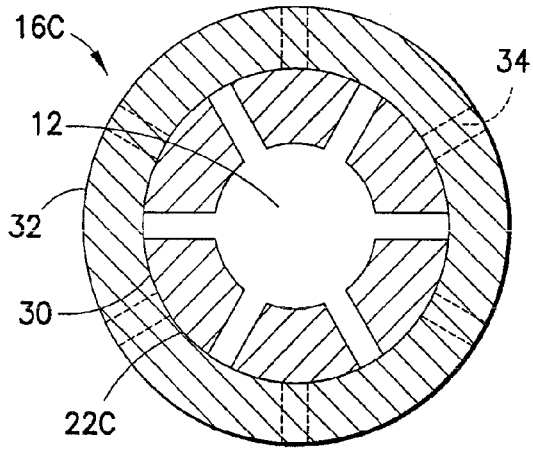
FIG. 6 is a cross-sectional end view of an electrical connector according to a fourth embodiment of the present invention.

FIG. 6 shows another sleeve 16C according to the present invention. The sleeve 16C generally comprises several metal or non-metal sections 30 positioned on an interior surface 22C of the sleeve 16C that are spaced apart or do not directly touch one another prior to implosion of the sleeve 16C. The metal or non-metal sections 30 may be held together by a flexible, perhaps sacrificial overmold 32 that may receive anchors 34 that extend from the several sections 30. Alternatively, the metal or non-metal sections 30 may be integrally formed with a compressible over mold 32 of like material. The several sections 30 may be wedge-shaped so the sections will interfere with one another as the overmold 32 is imploded by explosives (not shown). This interference is believed to limit compressive force on the core 12.

Figure 7:
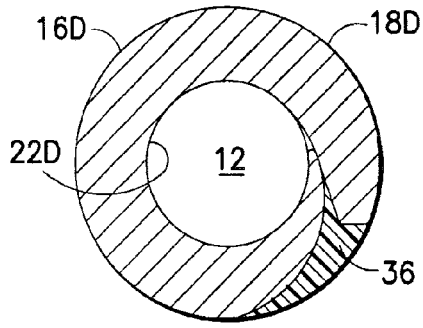
FIG. 7 is a cross-sectional end view of an electrical connector according to a fifth embodiment of the present invention.

FIG. 7 shows a sleeve 16D that overlaps over itself. Flexible material 36 such as rubber or plastic can fill in an overbite formed between overlapping edges to make the exterior surface 18D uniform in shape. For asymmetric exterior surfaces, explosive material (not shown for clarity) can be arranged on the exterior surface 18D of the sleeve 16D to compensate for the overlapped metal. In addition, interior surface 22D edges of the sleeve 16D adjacent to the overbite can be rounded to help prevent piercing of the core 12.

Figure 8:
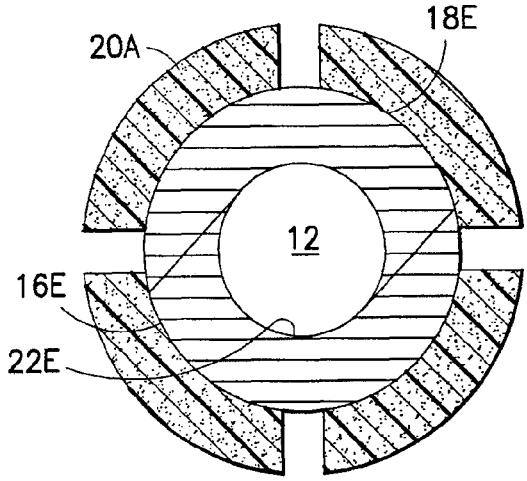
FIG. 8 is a cross-sectional end view of an electrical connector according to a sixth embodiment of the present invention.

FIG. 8 depicts a sleeve 16E with segmented explosive material 20A positioned adjacent an exterior surface 18E of the sleeve 16E. The segmented explosive material 20A can be detonated simultaneously or in sections to help prevent the non-steel core 12 adjacent to the interior surface 22E of the sleeve 16E from being crushed. The sleeve 16E is also segmented, shown as two angled lines, to allow for more controlled compression of the sleeve 16E during implosion.

Figure 9:
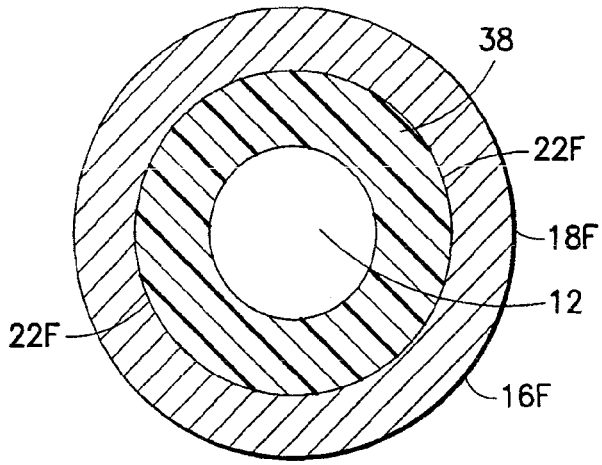
FIG. 9 is a cross-sectional end view of an electrical connector according to a seventh embodiment of the present invention.

The sleeve 16F in FIG. 9 has an exterior surface 18F and a metal, non-metal, or semi-metallic material 38 on the interior surface 22F of the sleeve 16F. The material 38 may be conductive plastic, the same material of the non-steel core 12, abrasive sponge, stainless steel, lead or lead free solder, epoxy or resin, or some other suitable material. Bonding between the core 12 and the material 38 may be enhanced by using material that is chemically similar or chemically or heat reactive with the core 12. Moreover, if the material is resilient, compression of the non-metal core 12 beyond its compression failure point may be reduced.

Figure 10:
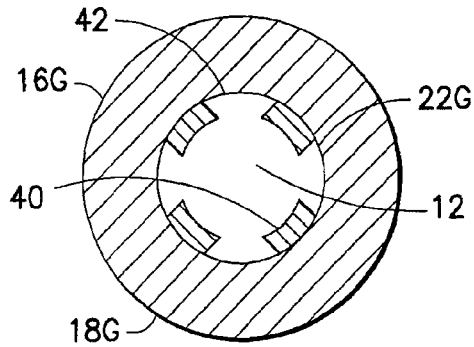
FIG. 10 is a cross-sectional end view of an electrical connector according to a eighth embodiment of the present invention.

As shown in FIG. 10, sleeve 16G may have an exterior surface 18G and an interior surface 22G that defines lands 40 and grooves 42. The lands 40 and grooves 42 may be parallel to each other and may form a spiraled rifling pattern. The lands 40 may be positioned opposite each other so that there are equal and opposite compressive forces on the core 12 during implosion of the sleeve 16G on the core 12 or the conductor 14 (FIG. 2).

Figure 11:
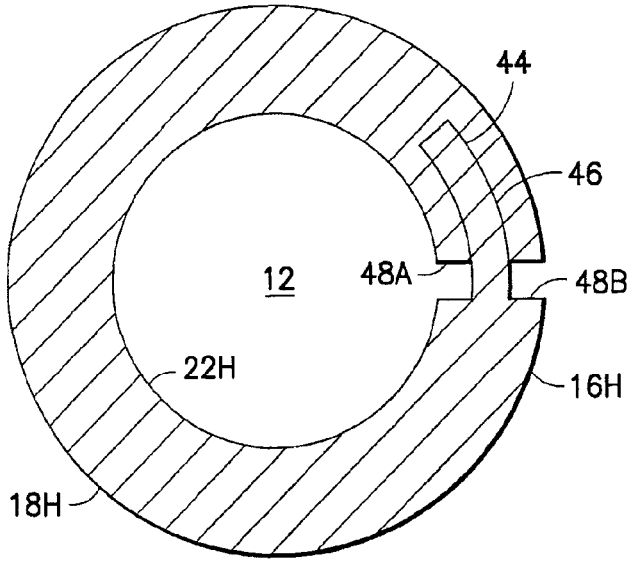
FIG. 11 is a cross-sectional end view of an electrical connector according to a ninth embodiment of the present invention.

FIG. 11 is another embodiment of the present invention. Sleeve 16H may define an exterior surface 18H, an interior surface 22H, and a radiused slot 44 that receives a radiused tab 46 that is shorter in length than a depth of the radiused slot 44. The sleeve 16H may compress around the non-steel core 12 or conductor 14 and the slot 44, tab 46, or surfaces 48A, 48B restrict the amount of allowable compression during implosion or other suitable radial compression.

Figure 12:
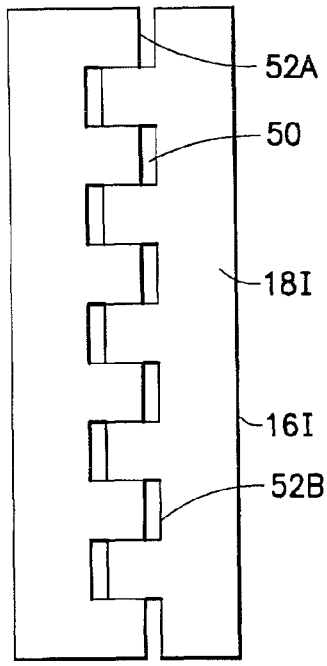
FIG. 12 is a side view of an electrical connector according to a tenth embodiment of the present invention.

FIG. 12 shows a sleeve 16I that comprises an exterior surface 18I and a serrated seam 50 defined by edges 52A, 52B of sleeve 16I. The edges 52A, 52B may define teeth and grooves that allow movement of the edges 52A, 52B with respect to each other, yet restrict the movement of the edges 52A, 52B to a predetermined distance during implosion. The teeth and grooves may be tapered to form an increasing interference fit as the sleeve 16I is compressed.

Figure 13:
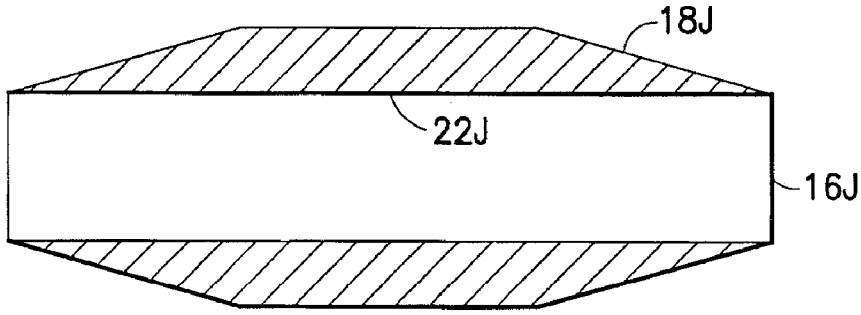
FIG. 13 is a cross-sectional side view of an electrical connector according to a eleventh embodiment of the present invention.
Figure 14:
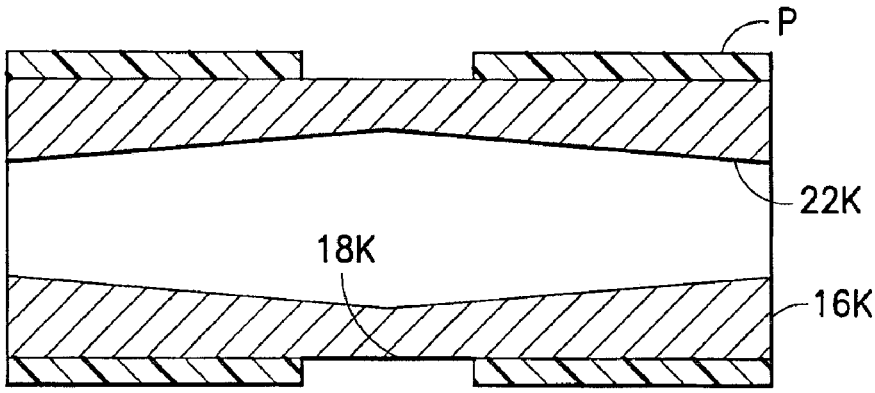
FIG. 14 is a cross-sectional side view of an electrical connector according to a twelfth embodiment of the present invention.

As shown in FIGS. 13 and 14, the exterior surfaces 18J, 18K or the interior surface 22J, 22K of sleeves 16J and 16K may be tapered in appearance. Plastic P, shown in FIG. 14, may be positioned on the exterior surface of the sleeves 16-16O.

Figure 15:
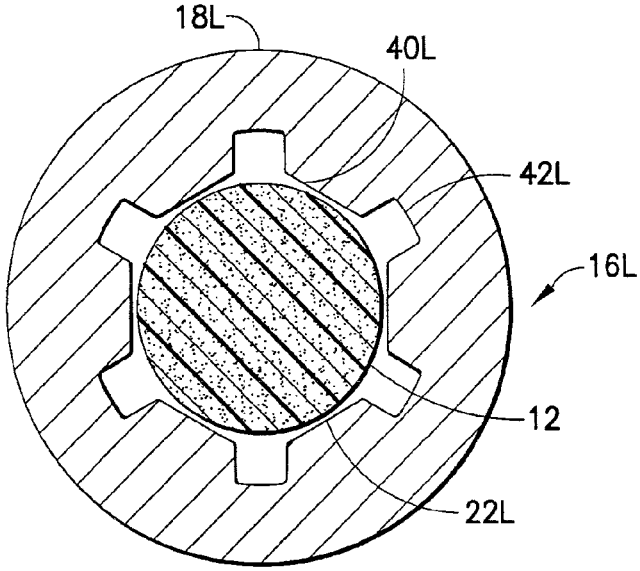
FIG. 15 is a cross-sectional end view of a thirteen embodiment electrical connector positioned around a composite core.

FIG. 15 shows a sleeve 16L with interior lands 40L and grooves 42L that are provided to prevent bird-caging of a conductor 14 wrapped around an exterior surface of the non-steel core 12. In the FIG. 15 embodiment, the lands 40L and grooves 42L are cut into the interior surface 22L of the sleeve 16L and the exterior surface 18L may be uniform in shape. Alternatively, the interior surface 22L may be smooth or comprise lands 40L and grooves 42L.

Figure 16:
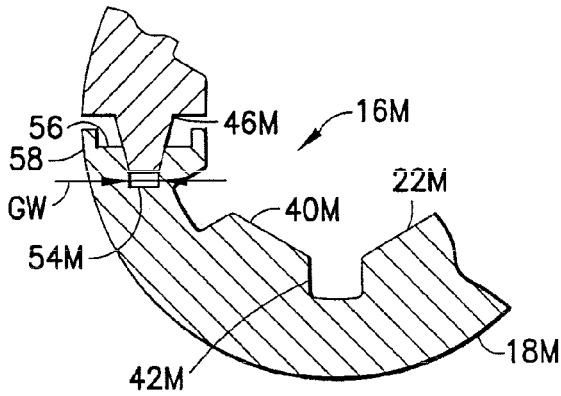
FIG. 16 is a partial cross-sectional end view of an electrical connector according to a fourteenth embodiment of the present invention.

FIG. 16 shows a sleeve 16M with a tab 46M on one connector piece and a slot 54M on a second connector piece. The tab 46M has a width greater than a gap width GW of the slot 54M. The second connector piece may further define a recess 56 that can receive metal shavings from the tab 46M as the first and second connector pieces are driven together by radial compression, such as by an explosive charge positioned on exterior surfaces 18M of the two part sleeve 16M. Upstanding walls 58 should be thick enough to prevent bowing away from the tab 46M during compression. The interior surface 22M may be smooth or comprise lands 40M and grooves 42M. The exterior surface 18M may be uniform on non-uniform in cross-section. The tabs 46M and slots 54M may form an increasing interference fit as they are compressed together.

Figure 17:
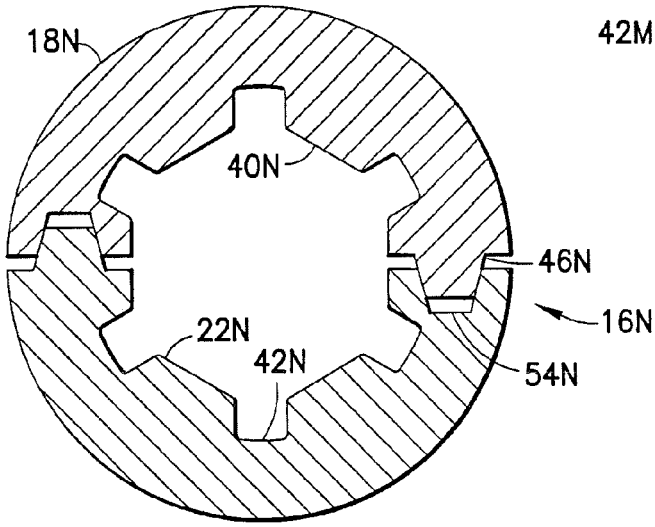
FIG. 17 is a cross-sectional end view of an electrical connector according to a fifteenth embodiment of the present invention.

FIG. 17 shows a two or more part sleeve 16N with opposed tabs 46N and slots 54N. The tabs 46N are preferably slightly larger in tapered width than the corresponding tapered slots 54N. The tabs 46N and slots 54N may form an increasing interference fit as they are compressed together. The interior surface 22N may be smooth or comprise lands 40N and grooves 42N. The exterior surface 18M may be uniform on non-uniform in cross-section. Sleeve separators may be included as discussed below.

Figure 18:
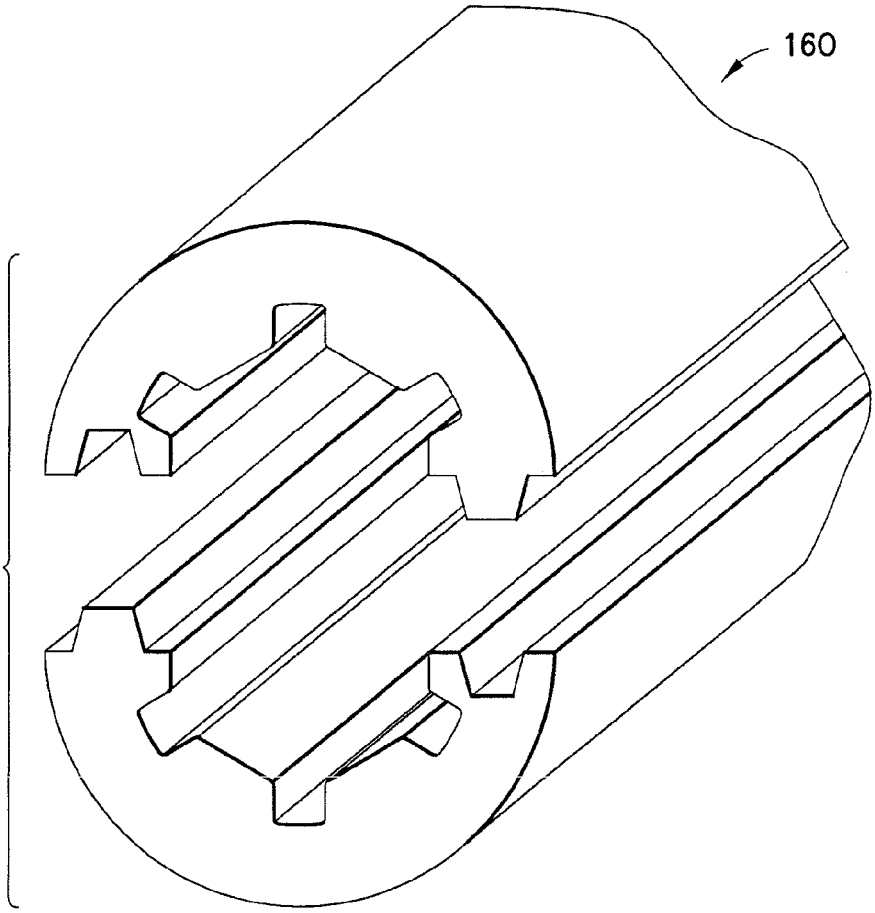
FIG. 18 is a perspective, exploded view of a non-metal sleeve according to a sixteenth embodiment of the present invention.

FIG. 18 is a non-metal inner sleeve 16O similar to the FIG. 17 sleeve 16N. Sleeve 16O is a compression regulator that may fit inside an outer metal sleeve (not shown). Both the sleeve 16O and the outer metal sleeve are compressed. The non-metal sleeve contacts the non-steel core 12 (FIG. 1) and the outer metal sleeve makes electrical connection with the conductor 14 (FIG. 1). Explosive material 20, 20A discussed above may be positioned around the outer metal sleeve.

Figure 19:
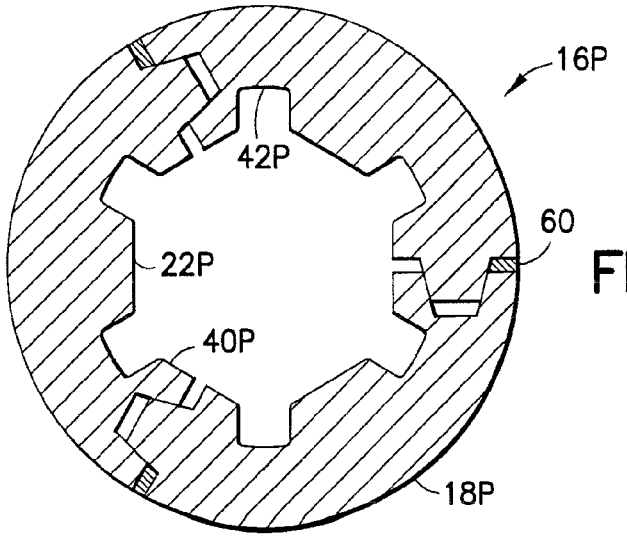
FIG. 19 is a cross-sectional end view of an electrical connector according to a seventeenth embodiment of the present invention.

FIG. 19 shows a three-part sleeve 16P. The three-part sleeve is similar to the sleeve 16N shown in FIG. 17. A removable or sacrificial spacer 60 may be included for manufacturing uniformity. The interior surface 22P of the sleeve 16P may be smooth or comprise lands 40P and grooves 42P. The exterior surface 18P may be uniform on non-uniform in cross-section.

Many modifications and other embodiments of the invention will come to the mind of one skilled in the art having the benefit of the teachings presented in the foregoing descriptions and associated drawings. For example, the sleeves 16-16P can be compressed or torqued with hydraulic tools, by hand, or with torque clamps to a pre-determined compression force that prevents core failure yet still holds the transmission line off of the ground. Accordingly, it is understood that the invention is not to be limited to the illustrated embodiments disclosed, and that other modifications and embodiments are intended to be included within the spirit and scope of this disclosure. Combinations of features of the various embodiments described above could also be included in other embodiments.

What is claimed is:

1. An electrical connector comprising:

a sleeve comprising an electrically conductive metal material and a channel adapted to receive an end of a non-metal composite core; and a compression regulator that is sized and shaped to allow the sleeve to be radially inwardly compressed a limited pre-determined amount to thereby form a friction engagement of the sleeve with the non-metal composite core and prevents the non-metal composite core from being crushed when the sleeve is radially inwardly compressed around the non-metal composite core.

2. An electrical connector as in claim 1, further comprising an implosion section comprised of explosive material, wherein the implosion section surrounds a portion of the sleeve.

3. An electrical connector as in claim 1 wherein the compression regulator is a compressible material positioned adjacent to the core.

4. An electrical connector as in claim 1 wherein the compression regulator is a plurality of spaced apart sections that each extend from an interior surface of the sleeve.

5. An electrical connector as in claim 1 wherein compression regulator is walls of the sleeve that are interlaced together.

6. An electrical connector as in claim 1 wherein the sleeve comprises two pieces.

7. An electrical connector as in claim 6 wherein the compression regulator comprises the two pieces comprising tapered slots and tapered wedges that fit into the tapered slots with an increasing interference fit as the two pieces are compressed towards each other.

8. An electrical connector as in claim 7 wherein at least one of the pieces comprises a metal shavings recess which is sized and shaped to receive metal shavings from one of the wedges.

9. An electrical connector as in claim 6 wherein the compression regulator comprises a slot, a tab that fits into the slot, and wherein the tab is shorter in length than the slot.

10. An electrical connector as in claim 1, wherein the compression regulator comprises a gap in the sleeve.

11. An electrical connector as in claim 10 further comprising a compressible material in the gap.

12. An electrical connector as in claim 1 wherein the compression regulator is brakes or lands and grooves in an interior wall of the sleeve section at the channel.

13. An electrical connector as in claim 1 wherein an interior wall of the sleeve at the channel has a plurality of recesses extending into the interior wall, from the channel.

14. An electrical connector as in claim 13 wherein the compression regulator is a plurality of tapered members that are separated from each other prior to compression and each extend into a respective one of the plurality of recesses.

15. An electrical connector as in claim 1 wherein a channel is formed by a wall of the sleeve which at least partially overlaps itself between the channel and an outer slide of the sleeve.

16. An electrical connector as in claim 1 wherein the sleeve section comprises a cross sectional shape which does not have a uniform wall thickness.

17. An electrical connector comprising:

a sleeve comprising an electrically conductive metal material and forming a channel adapted to receive an end of a non-metal composite core, wherein the sleeve comprises a first member having ends adapted to mate with ends of at least one separate second member of the sleeve; and a compression regulator that is adapted to allow the first and second members to be radially inwardly compressed a limited pre-determined amount to thereby form a friction engagement of the first and second members with the non-metal composite core and prevents the non-metal composite core from being crushed when the first and second members are radially inwardly compressed around the non-metal composite core, wherein the compression regulator comprises the ends of the first and second members comprising mating projections and receiving grooves, and wherein, the projections and grooves are sized and shaped to provide increasing resistance along lateral sides of the projections and grooves to insertion of the projections into the grooves from when the projections and grooves first touch to thereby provide an increasing interference fit as the projections are further pushed into the grooves.

18. An electrical connector as in claim 17 wherein at least one of the first and second members comprises a metal shavings recess which is sized and shaped to receive metal shavings from one of the projections.

19. An electrical connector as in claim 17, further comprising an implosion section comprised of explosive material, wherein the implosion section surrounds a portion of the sleeve.

* * * * *